US006662380B1

(12) United States Patent
Leonard et al.

(10) Patent No.: US 6,662,380 B1
(45) Date of Patent: Dec. 16, 2003

(54) DUAL ACTION TOILET RIM MOUNTED TOILET BOWL CLEANER

(75) Inventors: Stephen B. Leonard, Franksville, WI (US); Jerome J. Veltman, Racine, WI (US); Megan L. Polzin, Racine, WI (US); Michael E. Klinkhammer, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 10/231,042

(22) Filed: Aug. 29, 2002

(51) Int. Cl.[7] ..... E03D 9/02
(52) U.S. Cl. ..... 4/231
(58) Field of Search ..... 4/222, 223, 227.1–227.7, 4/231

(56) References Cited

U.S. PATENT DOCUMENTS

| | | | | |
|---|---|---|---|---|
| 633,390 A | | 9/1899 | Schell | |
| 680,179 A | | 8/1901 | Schoneman | |
| 1,067,472 A | * | 7/1913 | Creed | 4/231 |
| 1,091,265 A | | 3/1914 | Wohlander | |
| 1,127,207 A | | 2/1915 | Doran | |
| 1,355,155 A | | 10/1920 | Lewin et al. | |
| 1,691,359 A | | 11/1928 | Pulkinghorn | |
| 2,278,723 A | | 4/1942 | Malsbary et al. | 137/165 |
| 2,424,174 A | | 7/1947 | Jensen et al. | 4/225 |
| 2,481,296 A | | 9/1949 | Dupuy | 299/23 |
| 2,520,056 A | | 8/1950 | Pozun | 4/228 |
| 2,761,151 A | | 9/1956 | Ferrando | 4/225 |
| 2,770,492 A | | 11/1956 | Kuss | 299/20 |
| 2,991,517 A | | 7/1961 | Bundy | 21/124 |
| 2,993,214 A | | 7/1961 | Franco | 4/228 |
| 3,181,731 A | | 5/1965 | Ellis | 222/57 |
| 3,254,841 A | | 6/1966 | De Loncker, Sr. | 239/42 |
| 3,398,862 A | | 8/1968 | Willis | 222/57 |
| 3,727,840 A | | 4/1973 | Nigro | 239/43 |
| 3,736,600 A | | 6/1973 | Drinkwater | 4/231 |
| 3,766,576 A | | 10/1973 | Ancel | 4/231 |
| 3,774,808 A | | 11/1973 | La Vange | 222/57 |
| 3,908,868 A | | 9/1975 | Peirish, Jr. | 225/145 |
| 3,946,448 A | | 3/1976 | Sioufy | 4/223 |
| 3,965,497 A | | 6/1976 | Corsette | 4/227 |
| 3,968,048 A | | 7/1976 | Bolan | 252/157 |

(List continued on next page.)

FOREIGN PATENT DOCUMENTS

| | | | |
|---|---|---|---|
| EP | 0538957 | 4/1993 | |
| EP | 0785315 | 7/1997 | |
| EP | 960984 A2 | 12/1999 | E03D/9/03 |
| EP | 1087067 A1 | 3/2001 | E03D/9/02 |
| GB | 2339214 | 1/2000 | |
| WO | WO 99/66139 | 12/1999 | |
| WO | WO 99/66140 | 12/1999 | |
| WO | WO02/40787 | 5/2002 | |
| WO | WO02/40791 | 5/2002 | |
| WO | WO 02/40792 | 5/2002 | |

* cited by examiner

*Primary Examiner*—Tuan N. Nguyen

(57) ABSTRACT

A device for dispensing toilet bowl treatment preparations, such as a cleaning liquid and a liquid containing a dissolved solid cleaner, from under the rim of a toilet bowl by way of the flow of water during a toilet flush is disclosed. The device comprises a bottle that holds a liquid and a base that is suspended from the toilet rim and holds the bottle. The base has a piercing post for opening a closure of the bottle. A wicking device that is supported by the base conveys the liquid to a dispensing position within the flow of flush water. The container holds a dissolvable solid product, and is configured to permit flush water to enter the container. The container has an exit opening that permits a mixture of water and dissolved product to be released from the container into the toilet bowl.

20 Claims, 8 Drawing Sheets

U.S. PATENT DOCUMENTS

| | | | | |
|---|---|---|---|---|
| 4,096,593 | A | 6/1978 | Vlahakis | 4/231 |
| 4,168,551 | A | 9/1979 | Hautmann et al. | 4/231 |
| 4,180,875 | A | 1/1980 | Wilson | 4/309 |
| 4,183,105 | A | 1/1980 | Womack | 4/1 |
| 4,285,074 | A | 8/1981 | Leinberry | 4/227 |
| 4,319,369 | A | 3/1982 | Lippincott, Sr. | 4/228 |
| 4,526,320 | A | 7/1985 | von Phillip et al. | 239/43 |
| 4,635,302 | A | 1/1987 | Dolan | 4/228 |
| 4,660,231 | A | 4/1987 | McElfresh et al. | 4/228 |
| 4,760,612 | A | 8/1988 | Dufau | 4/225 |
| 4,777,670 | A | 10/1988 | Klinkhammer et al. | 4/231 |
| 4,984,306 | A | 1/1991 | Sumerix | 4/224 |
| 4,995,555 | A | 2/1991 | Woodruff | 239/43 |
| 5,152,015 | A | 10/1992 | Fourman | 4/225.1 |
| 5,347,661 | A | 9/1994 | Fly et al. | 4/225.1 |
| 5,488,742 | A | 2/1996 | Liao | 4/227.3 |
| 5,634,592 | A | 6/1997 | Campau | 239/51 |
| 5,945,390 | A | 8/1999 | Veltman et al. | 510/191 |
| 6,003,161 | A | 12/1999 | Tomaini | 4/415 |
| 6,178,564 | B1 | 1/2001 | Leonard et al. | 4/223 |
| 6,184,192 | B1 | 2/2001 | Klinkhammer | 510/191 |
| 6,230,334 | B1 | 5/2001 | Camp et al. | 4/231 |
| 6,376,442 | B1 | 4/2002 | Perthuisot et al. | |
| 2002/0148036 | A1 | 10/2002 | Wilson et al. | 4/231 |

DUAL ACTION TOILET RIM MOUNTED TOILET BOWL CLEANER

CROSS-REFERENCES TO RELATED APPLICATIONS

Not Applicable.

STATEMENT REGARDING FEDERALLY SPONSORED RESEARCH

Not Applicable.

BACKGROUND OF THE INVENTION

Field of the Invention

This invention relates to liquid dispensers, and in particular to devices for dispensing quantities of liquids, such as cleaning liquids and liquids containing a dissolved cleaning product, from under the rim of a toilet bowl.

Description of the Related Art

Toilet bowls require care to prevent the buildup of unsightly deposits, to reduce odors and to prevent bacteria growth. Traditionally, toilet bowls have been cleaned, deodorized and disinfected by manual scrubbing with a liquid or powdered cleaning and sanitizing agent. This task has required manual labor to keep the toilet bowl clean.

In order to eliminate the manual scrubbing, various automatic continuous cleaning toilet bowl cleaning products have been proposed. One type of product comprises a solid block or solid particles of a cleansing and freshening substance that is suspended from the rim of a toilet bowl in a container that is placed in the path of the flushing water. U.S. Pat. No. 3,529,309 shows an example of this type of toilet bowl cleaning system. Typically, a portion of the solid block is dissolved in the flush water with each flush, and the flush water having dissolved product is dispensed into the toilet bowl for cleaning the bowl. These solid block toilet cleaning systems have certain disadvantages such as a short lifetime and a decline in the amount of cleaning and deodorizing agents released into the toilet bowl as the solid block deteriorates.

Other automatic, continuous cleaning, toilet bowl cleaning systems use a liquid cleaning agent that is dispensed into a toilet bowl. For example, European Patent Application Nos. EP-0538957 and EP-0785315, U.S. Pat. Nos. 6,178,564 B1 and 6,230,334 B1, and PCT International Publication Nos. WO 99/66139 and WO 99/66140 all disclose cleansing and/or freshening units capable of being suspended from the rim of a toilet bowl for the purpose of introducing liquid active substances from a bottle into the flushing water with each flush. Typically, the liquid active substances may include one of more of the following: surfactants (such as a mixture of an anionic surfactant and a nonionic surfactant), solvents, sequesterants, pH controllers, thickeners, preservatives, fragrances, and dyes.

While these under the toilet rim liquid dispensing toilet bowl cleaning systems provide an improved alternative to the solid block toilet cleaning systems described above, it may be difficult to incorporate certain toilet bowl cleaning actives, such as bleaches and various hypochlorites, into the liquid active substance. In this regard, bleaches and hypochlorites may affect properties of the components of the liquid active substance. For example, bleaches and hypochlorites will typically fade the color of a dye and destroy a fragrance upon extended contact. Also, certain incompatible cleaning actives may not be stable when mixed and through the resulting chemical interaction, the efficacy of the individual cleaning actives may be decreased. For instance, the efficacy of certain surfactants may be decreased by bleaches and hypochlorites. These limitations in liquid dispensing cleaning systems have prevented the optimization of toilet bowl cleaning active substances in one liquid formulation. In particular, the inability to incorporate bleaches and hypochlorites into a liquid active substance is especially detrimental as bleaches and hypochlorites are particularly effective in destroying bacteria and preventing biofilm formation.

Binary cleaning systems have been proposed for certain applications such as drain cleaning. See, for example, U.S. Pat. No. 3,968,048. In such systems, the components are separately stored and mixed at the time of use. However, manual mixing defeats the automatic nature of toilet bowl cleaning systems, and automatic mixing systems suitable for administering such two part cleaners are too large and bulky for mounting under a toilet bowl rim.

One disadvantage with both solid block toilet bowl cleaning systems and liquid dispensing toilet bowl cleaning systems is the timing in which liquid substances are delivered to the toilet bowl. Often, the dissolved solid product and the liquid substances are only delivered to the toilet bowl during a toilet flush. However, it has been discovered that one key to more effective toilet bowl cleaning is having some cleaning actives remain in the bowl after the flush. As a result, solid block toilet bowl cleaning systems and liquid dispensing toilet bowl cleaning systems that only deliver active cleaning substances to a toilet bowl during a flush may not achieve maximum cleaning effectiveness.

Therefore, there is a need for an improved device that can dispense quantities of cleaning and freshening liquids from under the rim of a toilet bowl both during and after a flush and that can deliver a greater variety of cleaning actives to a toilet bowl, including incompatible cleaning actives.

BRIEF SUMMARY OF THE INVENTION

The foregoing needs are met by a dispensing device according to the invention in which a flow of water during a toilet flush is used to dispense toilet bowl treatment preparations into a toilet bowl. The dispensing device comprises a bottle for holding a liquid, a base for holding the bottle, a wicking device supported by the base, a container attached to the base, and means for suspending the base from a rim of the toilet bowl. The bottle has a mouth and a closure for covering the mouth, and the base has a piercing post. The wicking device is configured to convey the liquid from the post to a dispensing position within the flow of water from a toilet flush. The container holds a dissolvable product (typically a solid), and is configured to permit water from the flow of water to enter the container during a toilet flush. The container also has an exit opening configured to permit a mixture comprising water and dissolved product to be released from the container into the toilet bowl.

The wicking device of the dispensing device may comprise any number of different wicking structures including a dispensing plate having an upper surface including at least one feed channel in fluid communication with the piercing post of the base, a plate with holes formed therein, or a porous pad. In one form, the wicking device is movably supported by the base such that the wicking device can be adjusted to function with toilet bowls of different shapes and different flushing systems. The use of a movable wicking device assures that liquid from the bottle can be conveyed from the piercing post to a dispensing position within the flow of water during a toilet flush regardless of the toilet bowl shape or flushing system.

In one version of the invention, the container exit opening comprises a dispensing conduit configured to permit a mixture comprising water and dissolved product to be released from the container into the toilet bowl such that a portion of the mixture is released into the toilet bowl after the toilet flush is complete. The dispensing conduit of the container may comprise an approximately vertical tubular conduit. Importantly, the container may also be configured such that an amount of water from the flow of water remains in the container and contacts the dissolvable product after the toilet flush is complete. The container may include a housing and a cover capable of being opened to allow replacement of the dissolvable product. In one form, the container attaches to the bottom end of the base by a snap fit engagement.

In a dispensing device according to the invention, the liquid and dissolvable product dispensing systems work in concert when mounted in the toilet bowl (on the rim) and flush water is washed over the dispensing device. The liquid dispensing system dispenses out an amount of liquid onto the wicking device. This liquid may contain fragrance and surfactants that are necessary to provide toilet bowl freshening and foaming during the flush. When the toilet is flushed, flush water is directed over the wicking device to mix the liquid with flush water and deliver the diluted liquid to the toilet bowl. Also, when the toilet is flushed, flush water is directed into the container filling up the container and allowing the dissolvable solid product to mix with the water in the container. Slots in the container allow excess water to be directed out. The dispensing conduit is positioned as a drain mechanism metering out the water/dissolved solid product mixture. The metering out of the water/dissolved solid product mixture can be adjusted to deliver the mixture slowly after the flush is complete. This delay allows for the active cleaners in the dissolvable product to remain in the bowl and provide cleaning power between flushes. After each flush, a certain amount of water is left within the housing to mix with the solid dissolvable product, thereby making a concentrated pool of water/dissolved solid product mixture for the next flush to dispense into the bowl during and after a flush.

It is therefore an advantage of the present invention to provide an improved device that can dispense quantities of cleaning and freshening toilet bowl treatment preparations from under the rim of a toilet bowl both during and after a flush.

It is another advantage of the present invention to provide a device that can dispense a greater variety of cleaning actives to a toilet bowl from under the rim of a toilet bowl.

It is a further advantage of the present invention to provide a device that can dispense storage incompatible cleaning actives to a toilet bowl from under the rim of a toilet bowl such that most (or all) of the undesirable chemical interaction between the incompatible cleaning actives is preempted and the user will benefit from the superior properties of each of the incompatible cleaning actives through a single application of each of the incompatible cleaning actives.

BRIEF DESCRIPTION OF THE DRAWINGS

These and other features, aspects, and advantages of the present invention will become better understood upon consideration of the following detailed description, appended claims, and drawings where:

DETAILED DESCRIPTION

Figure 12:
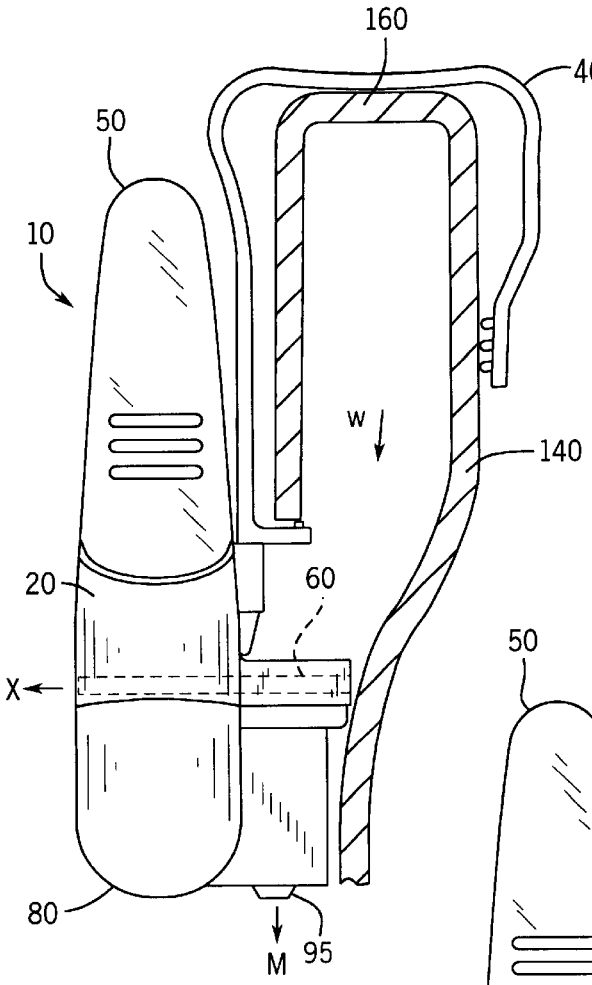
FIG. 12 is a side view showing the dispenser shown in FIG. 1 installed on an open rim type toilet bowl.
Figure 13:
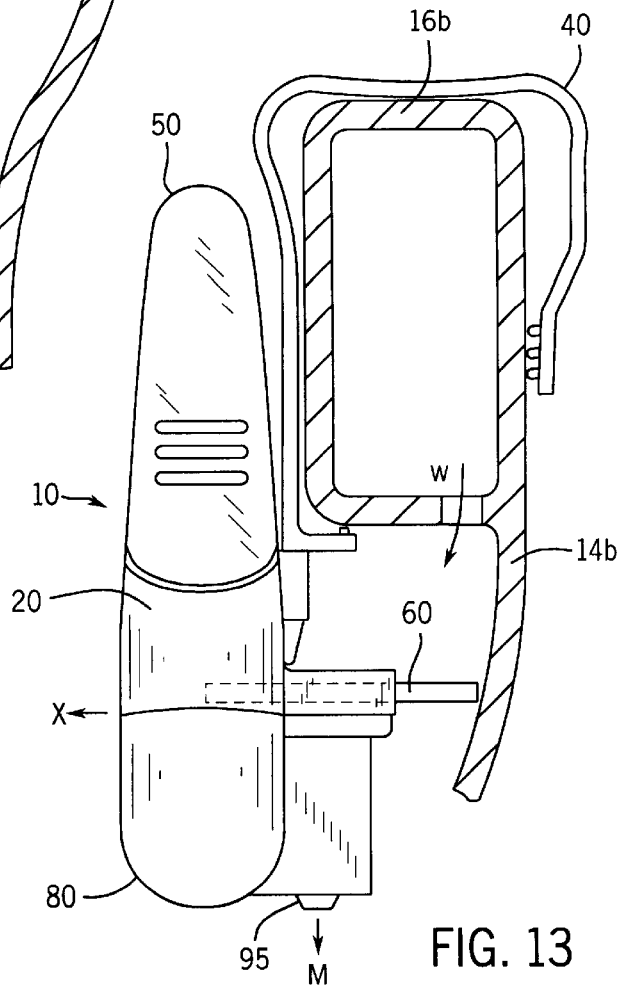
FIG. 13 is a view similar to FIG. 12, but with the dispenser shown in FIG. 1 installed on a box rim type toilet bowl.

Referring to FIGS. 1 to 16, there is shown a liquid dispenser 10 for dispensing toilet bowl treatment preparations from the rim of a toilet bowl. The dispenser 10 includes a base 20, a sprung suspension hook 40 for suspending the base 20 from the rim of a toilet bowl (as shown in FIGS. 12 and 13), a reservoir bottle 50 containing a liquid 58, a wicking device 60 that is supported by the base 20, and a solid dissolvable product container 80 that is attached to the base 20. The liquid 58 used in the bottle 50 may be any liquid formula having the cleaning, foaming, disinfecting and fragrancing characteristics required for the specific toilet cleaning application. One example liquid 58 comprises an anionic surfactant, a nonionic surfactant, a solvent, a sequesterant, a base to control pH, a thickener, a preservative, a fragrance, and a dye. Another example liquid is disclosed in European patent application no. EP 775,741 and comprises 1–25 wt. % perfume, 10–50 wt. % anionic or non-ionic surfactant, 1–20 wt. % evaporation regulator, and balance solvent. Once the liquid dispenser 10 is suspended from a toilet bowl such as that shown in FIGS. 12 and 13, a user inserts a sealed inverted reservoir bottle 50 into the base 20. The act of insertion causes a seal on the reservoir bottle 50 to break, in a manner to be described below. A wicking device 60 which may be in the form of a dispensing plate or porous pad is located within the base 20, and this wicking device 60 conveys liquid 58 from the reservoir bottle 50 to a position within the stream of flushing water within the toilet bowl by capillary action.

While a variety of materials may be used to form the base 20, the suspension hook 40, the bottle 50 and the container 80, it is preferable to manufacture these components from a thermoplastic material such as polyethylene or polypropylene. Typically, the base 20, the suspension hook 40 and the container 80 comprise an opaque thermoplastic material such as pigmented polyethylene or polypropylene, and the bottle 50 comprises a transparent thermoplastic material such as clear polyethylene or polypropylene. For ease of manufacture, the suspension hook 40 is formed as a separate component from the base 20, and the base 20 is formed with an integral guide channel 21 (see FIG. 2) of rectangular cross-section into which the lower end of the suspension hook 40 is inserted during assembly. The lower end of the suspension hook 40 comprises a raised, chamfered portion 42, such that, upon insertion, the hook 40 remains engaged within the channel 21 by a snap-fitting arrangement.

Figure 1:
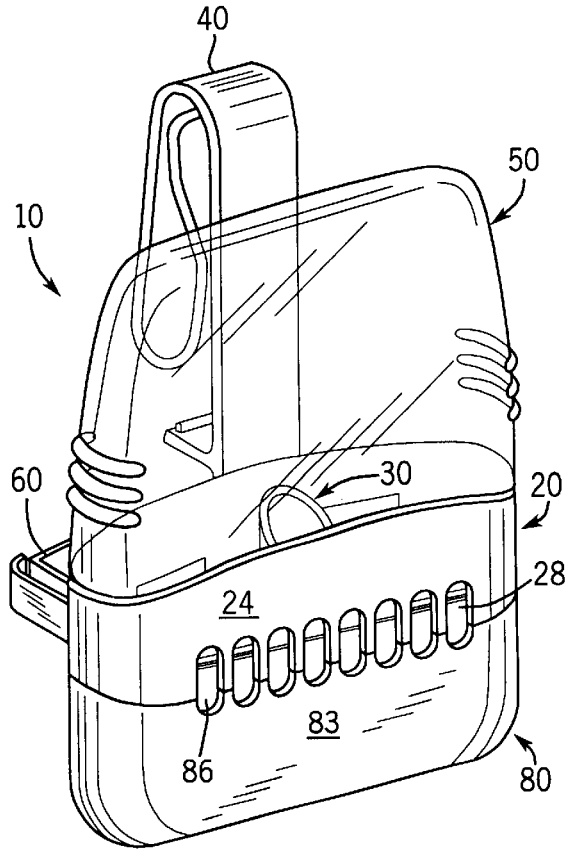
FIG. 1 is a perspective view of a dispenser in accordance with the invention.
Figure 2:
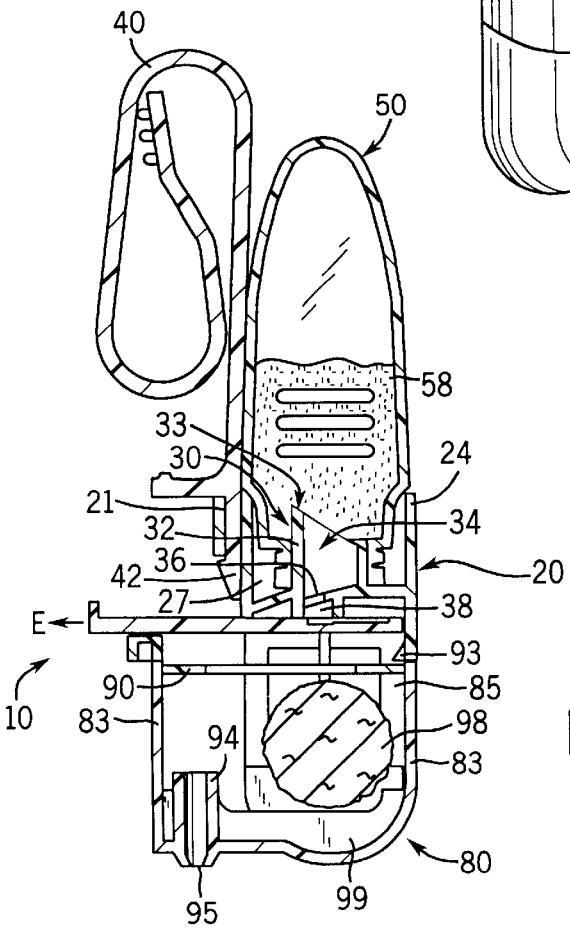
FIG. 2 is a vertical cross-sectional view of the dispenser shown in FIG. 1.

The base 20 includes a side wall 24 that terminates at an upper edge 25. The side wall 24 and the upper edge 25 create a mounting structure that holds the bottle 50 when the bottle 50 is installed on the base 20. The inner surface of the side wall 24 may also include ribs to further retain the bottle 50 in the base 20. In an inner central portion of the base 20, as best seen in FIG. 2, there is provided an annular channel 27 that runs adjacent a piercing post 30 that is used to carry fluids from the bottle 50 when the liquid dispensing device 10 is installed on a toilet rim. The base 20 is also formed with a series of drain slots 28 (best shown in FIG. 5) at the bottom of the front side which allow the flushing water to drain away from above the wicking device 60.

Figure 3:
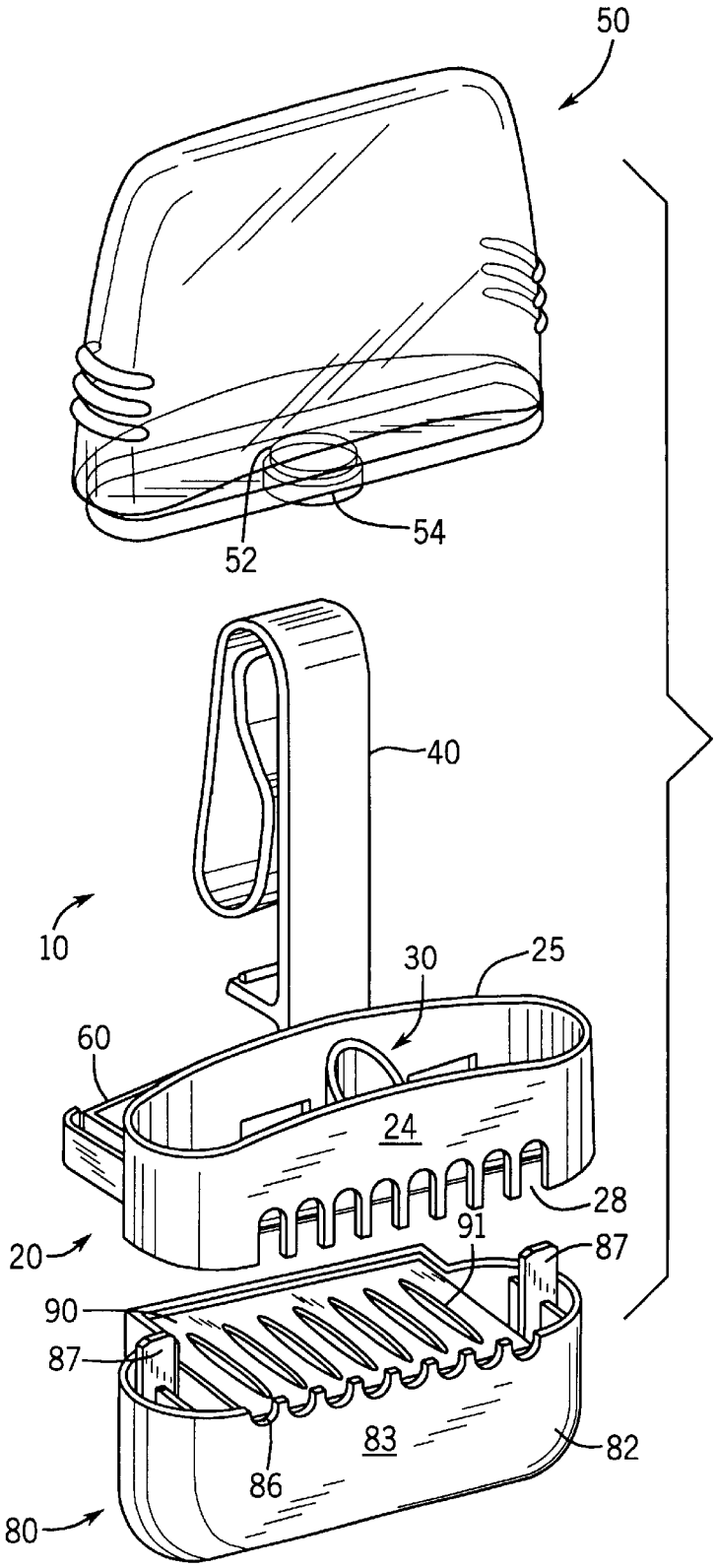
FIG. 3 is an exploded perspective view of the dispenser shown in FIG. 1.
Figure 5:
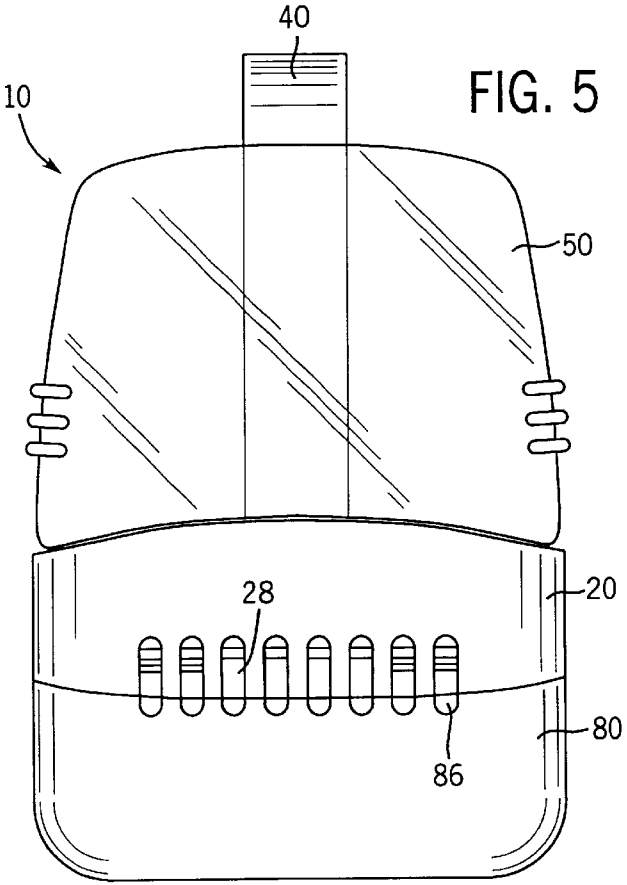
FIG. 5 is a front view of the dispenser shown in FIG. 1.
Figure 4:
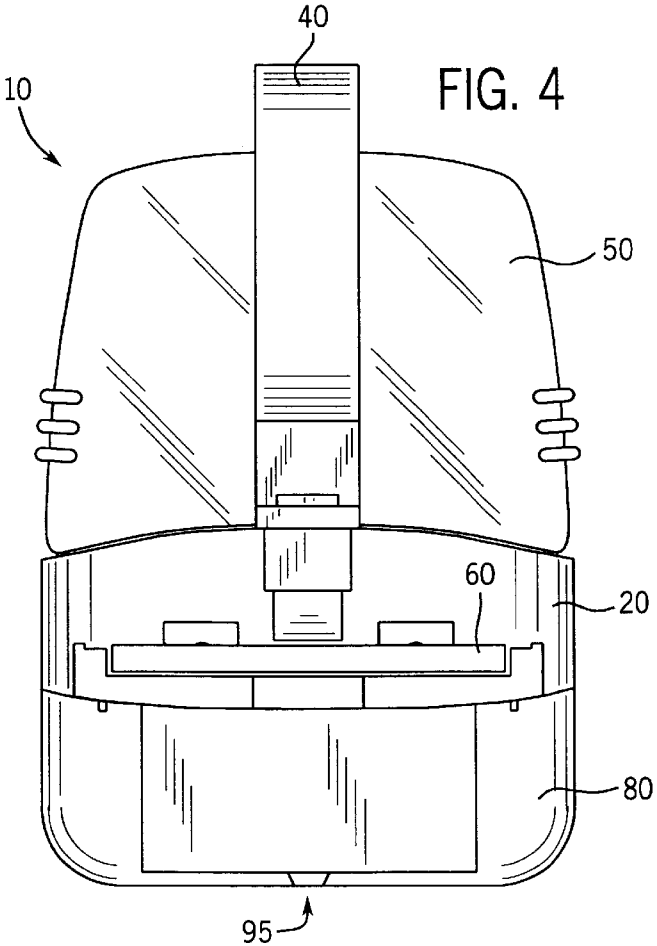
FIG. 4 is a rear view of the dispenser shown in FIG. 1.

The installation of the bottle 50 on the base 20 is best shown in FIGS. 2 and 3. The piercing post 30 of the base 20 comprises a cylindrical tubular section 32 that defines a feed conduit 34. An upper end 33 of the tubular section 32 terminates obliquely to form an elliptical mouth. The bottle 50 includes a circular mouth 52 that is covered by a closure 54 that seals the liquid 58 in the bottle 50 for shipment and storage. In the version of the bottle shown in the FIG. 3, the closure 54 is a thermoplastic cap with a channel that engages a circular flange at the mouth 52 of the bottle 50. Other closures, such as foil or plastic film, would also be suitable for sealing the mouth 52 of the bottle 50. The central portion of the closure 54 shown in FIG. 3 has a frangible seal with a circular area of reduced thickness.

During installation, the inverted bottle 50 is oriented over the piercing post 30 of the base 20 such that the circular inner wall of the closure 54 approximately lines up with the circular outer surface of the piercing post 30, and the bottle is moved in a downward direction until the upper end 33 of the piercing post 30 causes the circular area of the frangible seal to fracture. The feed conduit 34 of the base 20 is then placed in fluid communication with the mouth 52 of the bottle 50 and liquid 58 may flow from the bottle 50 through the feed conduit 34 and out of a dispensing hole 36 at the bottom of the piercing post 30 by way of gravity. By properly dimensioning the piercing post 30 and the closure 54 and the mouth 52 of the bottle 50, a fluid tight seal is formed when the bottle is installed on the base 20. The base 20 further comprises an outlet portion 38 in the form of a cylinder which bears against the wicking device 60.

Figure 14:
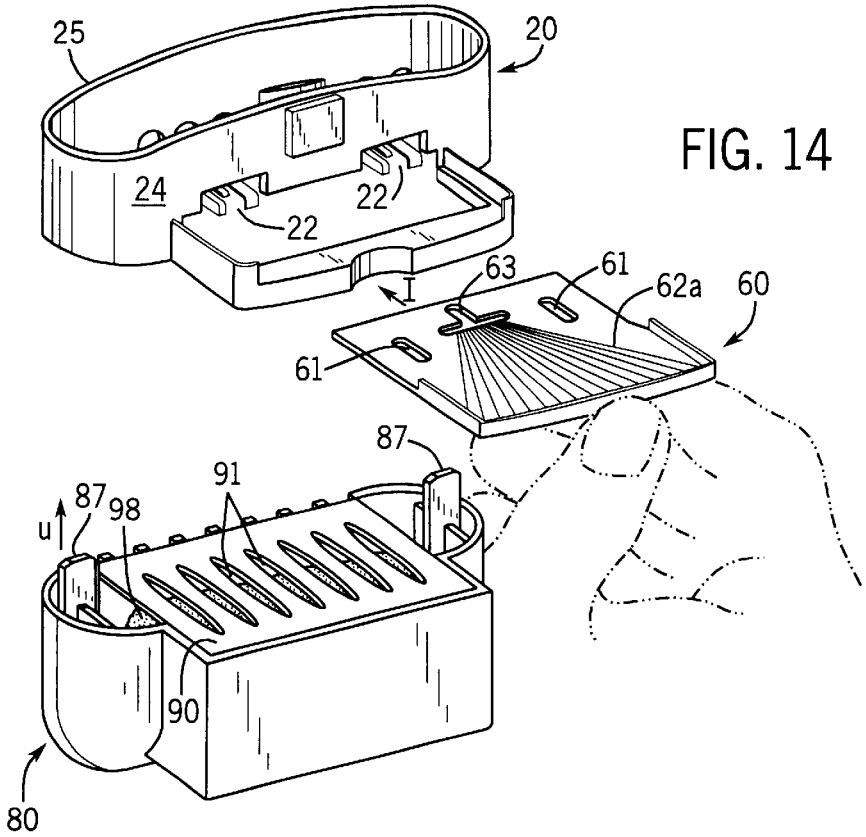
FIG. 14 illustrates schematically the manner in which a wicking device may be inserted into the base of the dispenser shown in FIG. 1.
Figure 15:
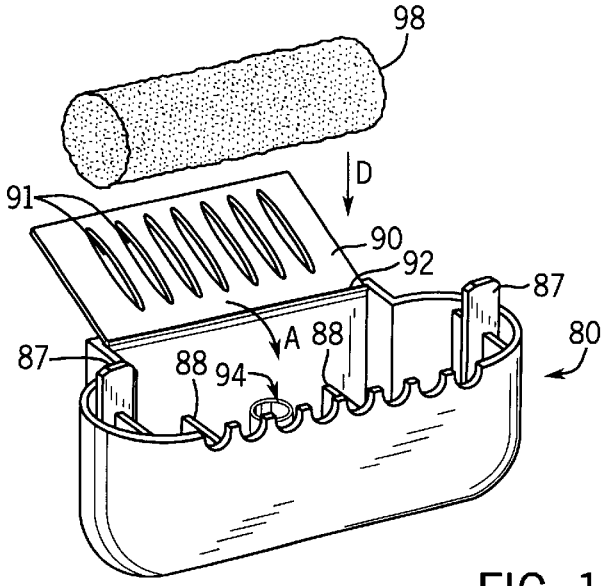
FIG. 15 is a perspective view of a solid dissolvable product container of the dispenser shown in FIG. 1.

The manner in which the wicking device is installed in the base 20 and the manner in which the position of the wicking device 60 can be adjusted by a user is illustrated in FIGS. 12 to 14. The wicking device 60 is provided with two elongate guide slots 61 which are engaged by two corresponding spring fingers 22 in the base 20. The wicking device 60 in moved in the direction of arrow I in FIG. 14 until the guide slots 61 are engaged by the spring fingers 22. The guide slots 61 serve to define the two extreme positions of the range of possible positions of the wicking device 60 within the base 20. The functioning of the adjustable wicking device 60 will now be described with reference to FIGS. 12 and 13. FIG. 12 illustrates the configuration of the dispensing device 10 when used with a toilet 140 with an open rim. With the dispensing device 10 suspended from the rim 160 of such a toilet 140, it can be seen that the stream of flushing water, indicated by the thick arrow W, contacts the wicking device 60 when the wicking device 60 is in the fully-inserted position in the base 20. However, when used with a toilet 14b of the boxed-rim configuration, as shown in FIG. 13, the wicking device 60 is withdrawn in direction E shown in FIG. 2 to a fully-extended position, as shown in FIG. 13, so as to expose a portion thereof to the stream of flushing water, indicated by the thick arrow W, while ensuring that the outlet portion 38 of the base 20 is still closed by the inner portion of the wicking device 60. As described above, this is ensured by virtue of the guide slots 61 within the wicking device 60 abutting the spring fingers 22 within the base 20.

Figure 6:
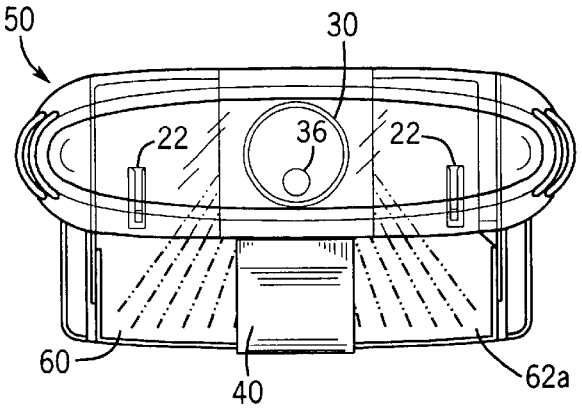
FIG. 6 is a top plan view of the dispenser shown in FIG. 1.
Figure 7:
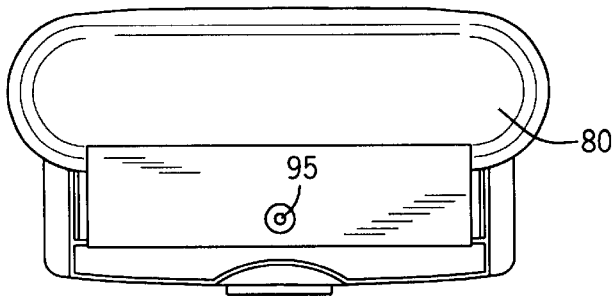
FIG. 7 is a bottom plan view of the dispenser shown in FIG. 1.
Figure 8:
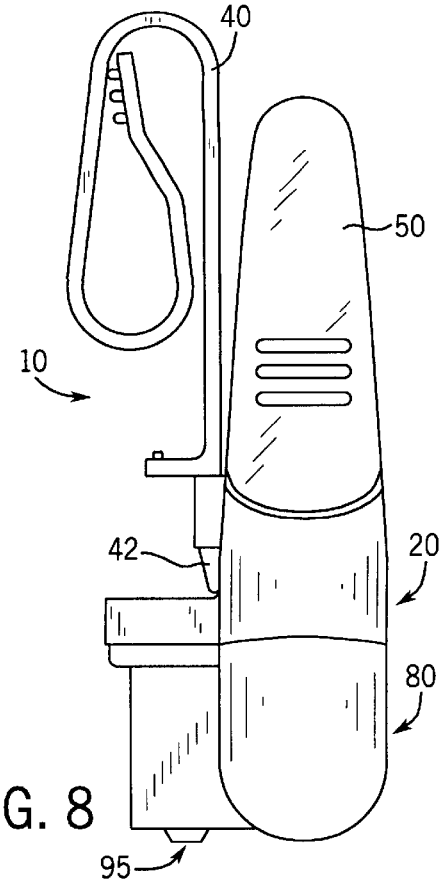
FIG. 8 is a side view of the dispenser shown in FIG. 1, the other side view being a mirror image.
Figure 16:
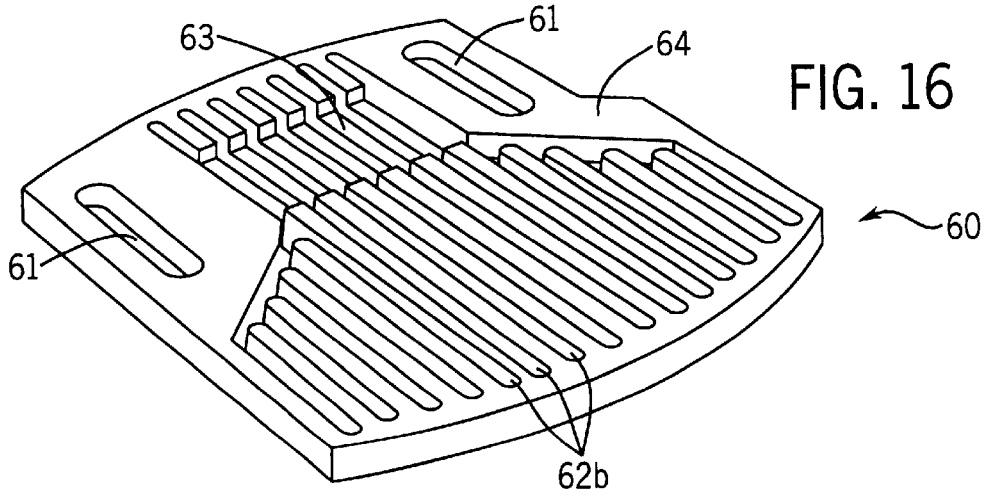
FIG. 16 is a perspective view of a wicking device that may be inserted into the base of the dispenser shown in FIG. 1.

Looking at FIGS. 6 and 16, the wicking device 60 may include capillary feed channels 62*a* that are arranged in a radiating fashion or capillary feed channels 62*b* that are arranged in parallel fashion in the top surface of a nonporous porous plate 64. A recess 63 is formed within the wicking device 60 to accommodate fluid from the inverted reservoir bottle 50. The wicking device 60 is attached to the base 20 such that the recess 63 of the wicking device 60 is placed in fluid communication with the feed conduit 34 of the base 20. In the version of the wicking device 60 shown in FIG. 2, the outlet portion 38 at the bottom of the piercing post 30 is used to provide a fluid path between feed conduit 34 and the recess 63 of the wicking device 60. As a result of this configuration, liquid flows out of the bottle 58, into the feed conduit 34 of the base 20, through the outlet portion 38 and into the recess 63 of the wicking device 60. Liquid 58 then flows from the recess 63 of the wicking device 60 into the capillary feed channels 62*a* in the upper surface of the wicking device 60. The liquid then continues to move toward the outer end of the capillary feed channels 62*a* where the liquid is mixed with flush water as described above with reference to FIGS. 12 and 13. Various means can be used to move the liquid from the recess 63 of the wicking device 60 into the capillary feed channels 62*a* or 62*b*. For example, the capillary action provided by adherence of the fluid to the sides of the capillary feed channels 62*a* or 62*b* serves to move the liquid toward the outer end of the capillary channels 62*a* or 62*b*. After the flushing water washes liquid from the wicking device 60 into the toilet water, a fresh supply of liquid 58 is distributed from the bottle 58 to the wicking device 60 as described above.

The structure of the container 80 and the manner in which the container 80 is attached to the base 20 are best illustrated in FIGS. 2, 3, 9, 10 and 11. The container 80 includes a housing 82 having an outer wall 83. The outer wall 83 defines a mixing chamber 85 in the housing 82. A dispensing conduit 94 (best shown in FIGS. 2 and 11) extends upward in the housing 82. Preferably, the dispensing conduit 94 comprises an approximately vertical tubular conduit. The dispensing conduit 94 is in fluid communication with the mixing chamber 85. The dispensing conduit 94 ends in a dispensing hole 95. The inner lower surface of the housing 82 may also include upwardly extending retaining walls 88 that hold a solid dissolvable cleaning product 98 (see FIGS. 10 and 15).

Some examples of suitable solid dissolvable cleaning products can be found in U.S. Pat. Nos. 6,184,192 and 5,945,390, which are incorporated herein by reference as if fully set forth herein. Preferably, the solid dissolvable product includes a bleaching agent, such as hydrogen peroxide, sodium peroxide, sodium chlorite, hypochlorous acid and mixtures thereof, or a chlorine releasing agent, such as chloroisocyanurates, hypochlorites, chlorosuccinimides, sodium para-toluene sulfochlorine, chlorodimethyl hydantoins, and mixtures thereof. One example solid dissolvable product comprises a solid chloroisocyanurate, such as an alkali metal chloroisocyanurate (e.g., sodium dichloroisocyanurate or sodium trichloroisocyanurate), and a water-soluble salt (which may be a mixtures of salts). Examples of water-soluble salts include various alkali metal and/or alkaline earth metal sulfates and chlorides, such as sodium sulfate, calcium sulfate, sodium chloride, potassium sulfate, calcium chloride, magnesium chloride, and magnesium sulfate. Optionally, the solid dissolvable product 98 may include a binder (e.g., a cellulose binder such as hydroxy ethyl cellulose, hydroxypropyl methyl cellulose, hydroxy propyl cellulose, methyl cellulose, ethyl cellulose, sodium carboxymethyl cellulose, ethyl hydroxyethyl cellulose, and carboxymethyl cellulose).

Certain components of the solid dissolvable product 98 may be incompatible with certain components of the liquid 58. As used herein, components are "incompatible" if the components are not stable over an hour of storage when mixed such that the efficacy of either of the individual components for their intended use is decreased. For example, two cleaning components are incompatible if a mixture of the two components decreases the cleaning effectiveness of one of the components, or a cleaning component and a dye are incompatible if a mixture of the two decreases the coloring effectiveness of dye and/or the cleaning effectiveness of the cleaning component.

Figure 9:
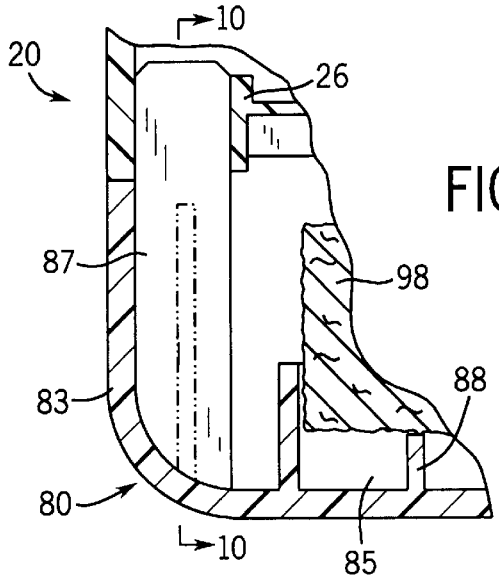
FIG. 9 is a partial cross-sectional view showing the means for attaching the container to the base of the dispenser shown in FIG. 1.
Figure 10:
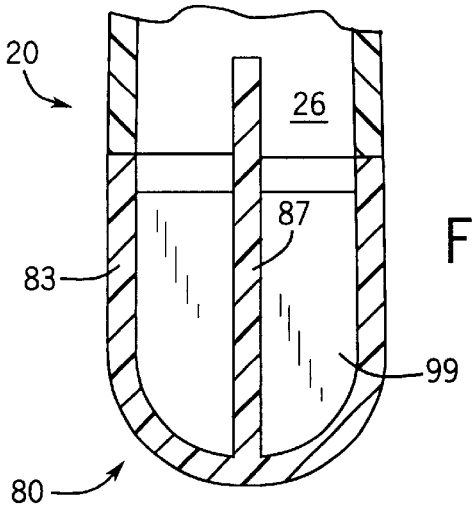
FIG. 10 is another partial cross-sectional view taken along line 10-10 of FIG. 9 showing the means for attaching the container to the base of the dispenser shown in FIG. 1.
Figure 11:
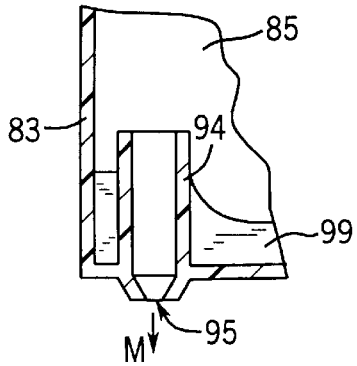
FIG. 11 is a partial cross-sectional view showing the dispensing conduit of the container of the dispenser shown in FIG. 1.

In the container 80, a closure flap 90 is attached to an upper edge on one side of the housing 82 by way of a living hinge 92. The closure flap 90 includes slots 91 that extend through the closure flap 90. The slots 91 allow for easier ingress and egress of water into the housing 82. After the dissolvable product 98 is moved into the housing in direction D and placed on the retaining walls 88 in the housing 82, the closure flap 90 is moved in the angular direction A shown in FIG. 15 to contain the product 98 in the container 80. The closure flap 90 is held in place by a snap catch 93 (shown in FIG. 2) on an inner wall of the housing 82. This provides child-resistant properties to the closure flap 90. One side of the upper portion of the housing 82, there are provided a plurality of drain slots 86. A pair of mounting tabs 87 extend upwardly from opposite ends of the inner lower surface of the housing 82 and are used to attach the container 80 to the base 20. Specifically, the container is moved in direction U in FIG. 14 until each of the mounting tabs 87 engages an inner surface of the outer wall 83 of the container 80 and an inner wall 26 of the base 20 in a press fit (snap fit) engagement as best shown in FIGS. 9 and 10. Of course, other attachment mechanisms such as adhesives would also be suitable.

Having described the structure of the dispenser 10, the operation of the dispenser 10 can be explained further. After the bottle 50 is installed in the base 20 of the dispenser 10 as described above, and the dispenser 10 is installed on a toilet bowl rim with proper adjustment of the wicking device 60 as described above with reference to FIGS. 12 and 13, the dispenser 10 is ready for operation. The liquid 58 flows out of the bottle 50, into the feed conduit 34 of the base 20, through the outlet portion 38 and onto the wicking device 60. Liquid 58 then flows toward the outer end of the wicking device 60 by way of capillary action of the capillary channels 62*a* or 62*b* as described above. When the toilet is flushed the liquid 58 is mixed with flush water as described above with reference to FIGS. 12 and 13. A mixture including flush water and liquid 58 is then distributed into the toilet. After the flushing water washes liquid 58 from the wicking device 60 into the toilet water, a fresh supply of liquid 58 is distributed from the bottle to the wicking device 60 as described above.

Also when the toilet is flushed, water from the flow of flush water enters the container 80 and serves to distribute a mixture 99 comprising water and dissolved product into the toilet bowl. This process can be best described by reference to FIGS. 2, 11, 12 and 13. First, water from the flow of flush water enters the housing 82 of the container 80. Optionally, liquid 58 from the bottle 50 may also be directed into the container 80. The flush water (and optionally liquid 58) then mixes with the solid dissolvable product 98 and a mixture 99 comprising water and dissolved product is formed in the mixing chamber 85. Excess water and some dissolved product is directed away from the container 80 in direction X by way of the drain slots 86 (best shown in FIGS. 12 and 13) and into the toilet bowl.

The dispensing conduit 94 of the container 80 provides a drain mechanism for metering out the water/dissolved solid product mixture 99 that is formed in the mixing chamber 85. The water/dissolved solid product mixture 99 exits the dispensing conduit 94 of the container 80 in direction M (best shown in FIGS. 11–13) and into the toilet bowl. By carefully choosing the dimensions of the dispensing conduit 94 and the dispensing hole 95, the metering out of the water/dissolved solid product mixture can be adjusted to deliver the water/dissolved solid product mixture 99 slowly after the flush is complete. This delay allows for the active cleaners in the solid dissolvable product 98 to remain in the toilet bowl and provide cleaning power between flushes. Also, after each flush, a certain amount of water is left within the housing 82 to mix with the solid dissolvable product 98, thereby making a concentrated pool of water/dissolved solid product mixture for the next flush to dispense into the bowl during and after a flush (see element 99 in FIG. 11).

Figure 17:
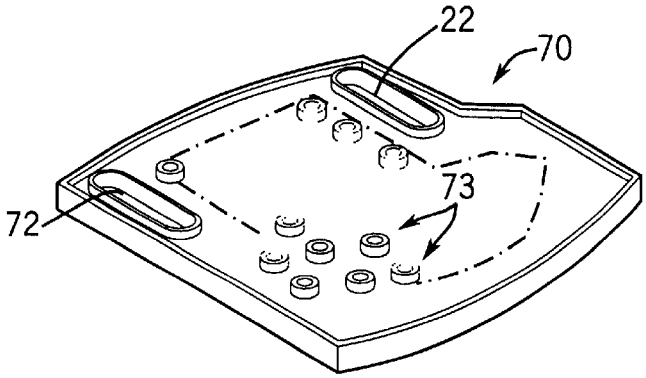
FIG. 17 is a perspective view of another version of a wicking device that may be inserted into the base of the shown in FIG. 1.

Turning now to FIG. 17, there is shown a perspective view of an alternative structure of the wicking device. The wicking device is in the form of a dispensing plate 70 having the same overall shape as the wicking device 60 that is illustrated in FIGS. 1–16, with elongate guide slots 72 that provide adjustability of position of the plate 70 to accommodate different lavatory geometries as described above with reference to FIGS. 12 and 13. In this embodiment of the wicking device, the plate 70 is solid apart from a number of raised through-holes 73 formed in the plate. In operation of a dispenser having this plate 70, liquid 58 flows out of the bottle 58, into the feed conduit 34 of the base 20, through the outlet portion 38 and onto the plate 70. When the toilet is flushed, the liquid 58 is mixed with flush water as described above with reference to FIGS. 12 and 13. A mixture including flush water and liquid is then distributed into the toilet through through-holes 73 in the plate 70. The through-holes 73 are sufficiently small to prevent the undiluted liquid 58 from passing through. After the flushing water washes liquid through through-holes 73 in the plate 70 into the toilet water, a fresh supply of liquid 58 is distributed from the bottle 50 to the plate 70 as described above.

A second alternative structure of the wicking device is a porous pad that is used to provide a fluid path between the bottle 50 and a dispensing position within the stream of flush water. In this configuration, liquid 58 flows out of the bottle 58, into the feed conduit 34 of the base 20, through the outlet portion 38 and onto the porous pad. The liquid then continues to move toward the outer end of the porous pad by capillary action where the liquid is mixed with flush water as described above with reference to FIGS. 12 and 13.

The use of both the cleaning, foaming, disinfecting and fragrancing liquid 58 and the solid dissolvable product 98 in the dispenser 10 provides for many advantages. For example, the solid dissolvable product 98 may include a bleaching agent or a chlorine releasing agent that would be incompatible with a dye in the liquid 58. By segregating the liquid 58 and the solid dissolvable product 98 in the dispenser 10, the bleaching agent or the chlorine releasing agent in the solid dissolvable product 98 cannot affect the coloring properties of the dye in the liquid 58. In fact, the segregation of the liquid 58 and the solid dissolvable product 98 would be advantageous in any situation where the solid dissolvable product 98 includes at least one component that is incompatible with at least one component of the liquid 58. The use of the dispensing conduit 94 and the dispensing hole 95 also provides for advantages. By carefully choosing the dimensions of the dispensing conduit 94 and the dispensing hole 95, the metering out of the water/dissolved solid product mixture can be adjusted to deliver the water/dissolved solid product mixture slowly after the flush is complete. In this manner, more effective toilet bowl cleaning is achieved by having some cleaning actives remain in the bowl after the flush.

Advantageously, the liquid dispenser 10, the cleaning, foaming, disinfecting and fragrancing liquid 58, and the solid dissolvable product 98 can be designed such that the supply of liquid 58 and the solid dissolvable product 98 are used up in substantially the same time period. Various methods can be used to assure that the liquid 58 and the solid dissolvable product 98 are used up in the same time period. One method involves the control of the concentration of components in the solid dissolvable product 98. In this example method, the solid dissolvable product 98 comprises a solid chloroisocyanurate, such as sodium dichloroisocyanurate or sodium trichloroisocyanurate, and a water-soluble salt such as sodium sulfate. The ratio of solid chloroisocyanurate to water soluble salt is adjusted to allow for various dissolution rates for the solid dissolvable product 98. When a faster dissolution rate is desired for the solid dissolvable product 98, the ratio of solid chloroisocyanurate to water soluble salt is decreased as a higher level of the water-soluble salt serves to increase the release rate of the solid dissolvable product 98 into the flush water. In the same manner, the ratio of solid chloroisocyanurate and water soluble salt is increased when a slower dissolution rate is desired for the solid dissolvable product 98. By measuring the dispensing rate for the liquid 58 and adjusting the ratio of solid chloroisocyanurate and water soluble salt in the solid dissolvable product 98, it is therefore possible to assure that the liquid 58 and the solid dissolvable product 98 are used up in the same time period. Of course, other variables that affect the dispensing rates of the liquid 58 and the solid dissolvable product 98 can be varied and controlled in order to assure that the liquid 58 and the solid dissolvable product 98 are used up in the same time period. For example, the volume of the liquid 58 and the solid dissolvable product 98 used can be varied, the size of the bottle 50 and the container 80 can be varied, and the size of the dispensing conduit 94 and the dispensing hole 95 can be varied.

Thus, there has been provided a device for dispensing toilet bowl treatment preparations, such as cleaning liquids and liquids containing a dissolved cleaner, from under the rim of a toilet bowl by way of the flow of water during a toilet flush. The dispensing device fulfills a need for an improved device that can automatically dispense quantities of cleaning and freshening toilet bowl treatment preparations from under the rim of a toilet bowl both during and after a flush. The device can dispense a greater variety of cleaning actives to a toilet bowl from under the rim of a toilet bowl, and in particular can dispense incompatible cleaning actives to the toilet bowl such that most of the chemical interaction between the incompatible cleaning actives is preempted and the user will benefit from the superior properties of each of the incompatible cleaning actives through a single application of each of the incompatible cleaning actives.

Although the present invention has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

INDUSTRIAL APPLICABILITY

The invention may be used for dispensing liquids, such as cleaning liquids and liquids containing a dissolved cleaner, from under the rim of a toilet bowl by way of the flow of water during a toilet flush.

We claim:

1. A dispensing device for using a flow of water during a toilet flush to dispense toilet bowl treatment preparations into a toilet bowl, the device comprising:

a bottle for holding a liquid, the bottle having a mouth and a closure for covering the mouth;

a base for holding the bottle, the base having a piercing post, the piercing post being suitable for opening the closure of the bottle;

a wicking device supported by the base, the wicking device being suitable to convey the liquid from the piercing post to a dispensing position within the flow of water during a toilet flush;

a container attached to the base, the container holding a dissolvable product, the container being configured to permit water from the flow of water to enter the container during a toilet flush, and the container including an opening configured to permit a mixture comprising water and dissolved product to be released from the container into the toilet bowl; and suspension means for suspending the base from a rim of the toilet bowl.

2. The dispensing device of claim 1, wherein the opening comprises a dispensing conduit configured to permit the mixture comprising water and dissolved product to be released from the container into the toilet bowl, the dispensing conduit being dimensioned such that a portion of the mixture is released into the toilet bowl after the toilet flush is complete.

3. The dispensing device of claim 2, wherein the dispensing conduit of the container comprises an approximately vertical tubular conduit.

4. The dispensing device of claim 2, wherein the container is configured such that an amount of water from the flow of water remains in the container and contacts the dissolvable product after the toilet flush is complete.

5. The dispensing device of claim 1, wherein the container comprises a housing and a cover capable of being opened to allow replacement of the dissolvable product.

6. The dispensing device of claim 1, wherein the wicking device comprises a dispensing plate having an upper surface including at least one feed channel in fluid communication with the piercing post of the base.

7. The dispensing device of claim 1, wherein the wicking device comprises a plate with holes formed therein.

8. The dispensing device of claim 1, wherein the wicking device comprises a porous pad.

9. The dispensing device of claim 1, wherein the wicking device is movably supported by the base such that the wicking device can be adjusted to function with toilet bowls of different shapes and different flushing systems.

10. The dispensing device of claim 1, wherein the container further includes drain slots in a side wall of the container.

11. The dispensing device of claim 1, wherein the container attaches to the base by a snap fit engagement.

12. The dispensing device of claim 1, wherein the container attaches to a bottom end of the base.

13. The dispensing device of claim 1, wherein the closure of the bottle comprises a frangible seal that is configured to be broken in use by pressing the frangible seal against an end portion of the piercing post.

14. The dispensing device of claim 1, wherein the base holds the bottle such that the bottle is supported in an inverted position with the mouth projecting downwardly such that the liquid can be dispensed from the bottle by gravity.

15. The dispensing device of claim 1, wherein the container is configured to permit an amount of the liquid to enter the container during a toilet flush.

16. The dispensing device of claim 1, wherein the dissolvable product comprises a solid including at least one component that is incompatible with at least one component of the liquid.

17. The dispensing device of claim 1, wherein the dissolvable product includes a bleaching agent or a chlorine releasing agent.

18. The dispensing device of claim 1, wherein the dissolvable product comprises a chloroisocyanurate and water soluble salt.

19. A dispensing device for using a flow of water during a toilet flush to dispense toilet bowl treatment preparations into a toilet bowl, the device comprising:

a bottle for holding a liquid, the bottle having a mouth and a closure for covering the mouth;

a base for holding the bottle, the base having a piercing post, the piercing post being suitable for opening the closure of the bottle;

a wicking device supported by the base, the wicking device being suitable to convey the liquid from the piercing post to a dispensing position within the flow of water during a toilet flush;

a container attached to the base, the container holding a dissolvable product, the container being configured to permit water from the flow of water to enter the container during a toilet flush, the container including a dispensing conduit configured to permit a mixture comprising water and dissolved product to be released from the container into the toilet bowl, the dispensing conduit being dimensioned such that a portion of the mixture is released into the toilet bowl after the toilet flush is complete; and suspension means for suspending the base from a rim of the toilet bowl, wherein the dissolvable product comprises a solid including at least one component that is incompatible with at least one component of the liquid.

20. The dispensing device of claim 19, wherein:

the dissolvable product includes a bleaching agent or a chlorine releasing agent.

* * * * *

UNITED STATES PATENT AND TRADEMARK OFFICE

CERTIFICATE OF CORRECTION

PATENT NO. : 6,662,380 B1
APPLICATION NO. : 10/231042
DATED : December 16, 2003
INVENTOR(S) : Stephen B. Leonard et al.

It is certified that error appears in the above-identified patent and that said Letters Patent is hereby corrected as shown below:

Column 11, Line 1: replace “claim 2” with --claim 1--

Signed and Sealed this

Twenty-sixth Day of May, 2009

JOHN DOLL
*Acting Director of the United States Patent and Trademark Office*